US005898787A

United States Patent [19]

Stanford

[11] Patent Number: 5,898,787

[45] Date of Patent: Apr. 27, 1999

[54] FETAL AND INFANT AUDIO BAG APPARATUS

[76] Inventor: Paul F. Stanford, 1050 Middle St., Weymouth, Mass. 02188

[21] Appl. No.: 09/092,723

[22] Filed: Jun. 5, 1998

[51] Int. Cl.[6] ..... H04R 25/00

[52] U.S. Cl. ..... 381/332; 381/386; 224/910

[58] Field of Search ..... 381/301, 87, 332, 381/333, 386, 388, 389; 224/224, 226, 240, 195, 228, 236, 904, 910

[56] References Cited

U.S. PATENT DOCUMENTS

| | | | |
|---|---|---|---|
| 4,830,007 | 5/1989 | Stein | 381/333 |
| 4,934,998 | 6/1990 | Thomas, Jr. | 128/1 R |
| 5,109,421 | 4/1992 | Fox | 381/333 |
| 5,353,975 | 10/1994 | Libertucci | 224/224 |
| 5,491,756 | 2/1996 | Francais | 381/332 |
| 5,699,558 | 12/1997 | Min | 381/332 |
| 5,771,305 | 6/1998 | Davis | 381/389 |

*Primary Examiner*—Huyen Le
*Attorney, Agent, or Firm*—John P. McGonagle

[57] ABSTRACT

A soft bag containing an audio system with multiple speakers and strap which may be worn about the abdomen of an expectant mother or carried separately by the non-expectant mother. The bag also has a storage area for carrying various sundries related to pregnancy and infants.

4 Claims, 2 Drawing Sheets

FETAL AND INFANT AUDIO BAG APPARATUS

BACKGROUND OF THE INVENTION

This invention relates to bags, and in particular to a bag containing a stereo speaker system which may be worn about the abdomen of an expectant mother or held apart from the mother.

It has been determined by many experts that a human fetus in the uterus of the mother can hear sound as early as twenty-four weeks after gestation. Consequently, various devices which previously had been used to monitor the fetus in utero have been modified to also provide sound stimulus to the fetus. It has become popular for many mothers to read to the fetus in utero as well as play music and other sound stimulus.

To provide the means for imparting sound stimulus to a fetus in utero, various devices have been provided in the prior art. Examples of such devices may be found in U.S. Pat. Nos. 5,491,756 "System For Delivering Sound To And Monitoring Effects On A Fetus"; 5,109,421 "Fetal Speaker System And Support Belt For Maternal Wear"; 4,934,998 "Prenatal Audio Apparatus"; and 4,830,007 "Fetus Learning System".

These devices are specific to the fetus in utero and have no other application. Because of the relatively short time in which sound stimulus has an effect on the fetus in utero, the devices of the prior art have a very short effective life span.

SUMMARY OF THE INVENTION

In view of the foregoing short effective life span inherent in the known types of devices now present in the prior art, the present invention provides a fetal audio bag apparatus which may be used with an infant ex utero. As such, the general purpose of the present invention, which will be described subsequently in greater detail, is to provide a bag with an audio system which may be used with a fetus in utero and an infant ex utero.

To attain this, the present invention provides a soft bag containing an audio system with multiple speakers and strap which may be worn about the abdomen of an expectant mother or carried separately by the non-expectant mother. The bag also has a storage area for carrying various sundries related to pregnancy and infants.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
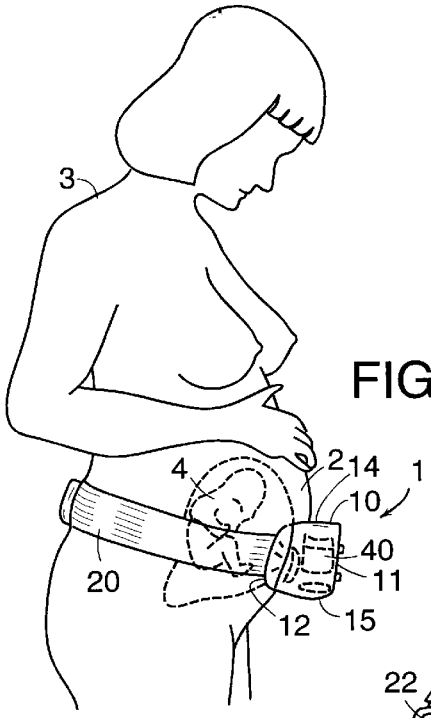
FIG. 1 is a perspective view of the bag imparting sounds to a fetus and worn by a mother.
Figure 2:
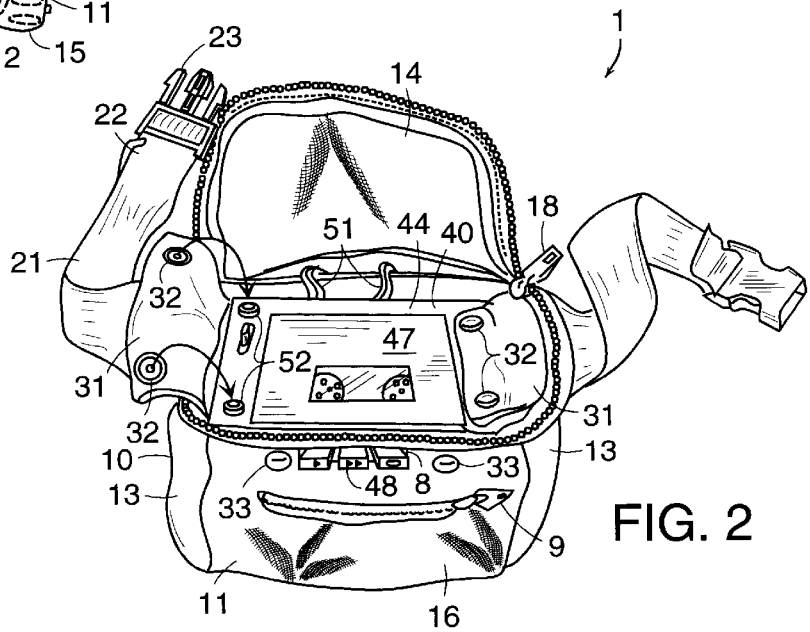
FIG. 2 is a front view of the bag with its top open.
Figure 3:
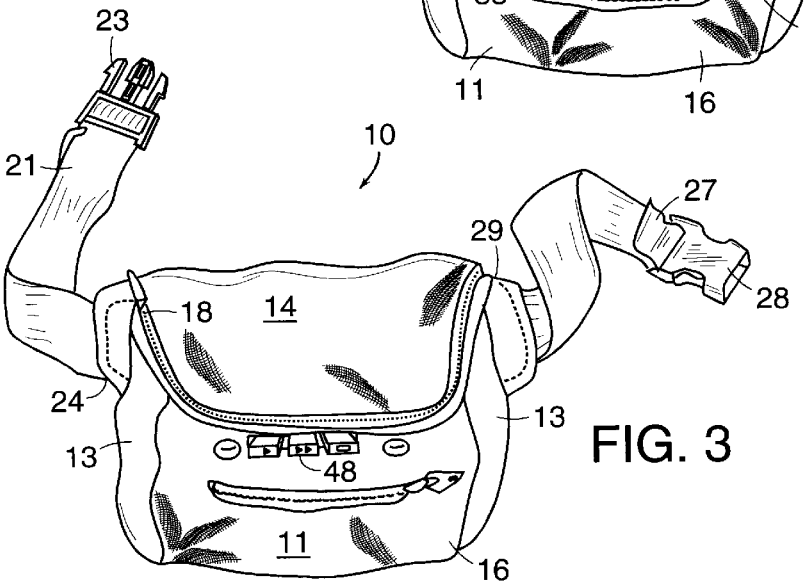
FIG. 3 is a view of the bag of FIG. 2 with its top closed.
Figure 4:
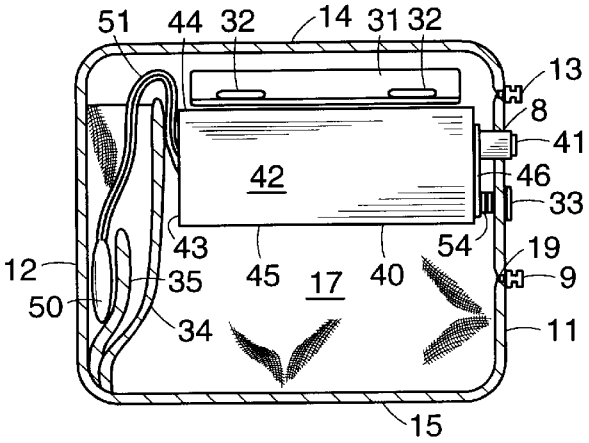
FIG. 4 is a side cross-sectional view of the bag of FIG. 3.
Figure 5:
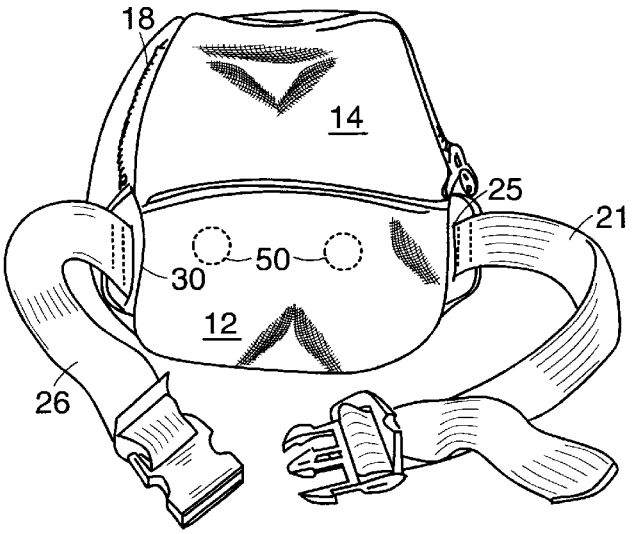
FIG. 5 is a rear view of the bag with its top closed.
Figure 6:
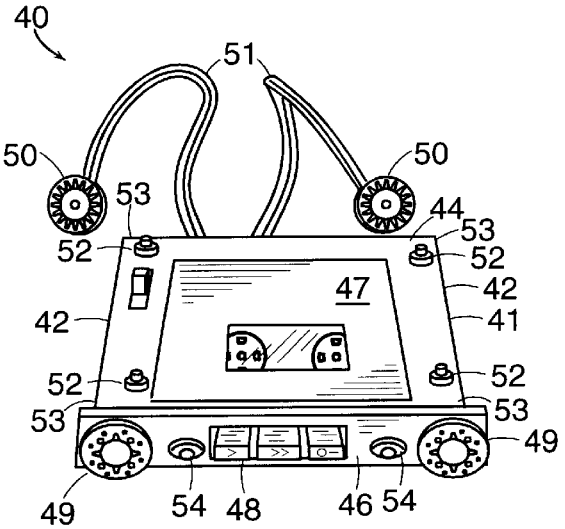
FIG. 6 is a front perspective view of the audio system contained in the bag.

Referring to the drawings in detail wherein like elements are indicated by like numerals, there is shown a fetal and infant audio bag apparatus 1 constructed according to the principles of the present invention. The apparatus 1 is comprised of a bag 10 and an audio system 40 contained therein.

The bag 10 has a front 11, a rear 12, two sides 13, a top 14, a bottom 15, an outer surface 16, and an interior 17. The top 14 is directly attached to the rear 12 and is connected by means of a zipper fastener 18 to the two sides 13 and front 11. By opening the zipper fastener 18, access to the bag interior 17 may be obtained. The bag front 11 has a central horizontal opening 19 formed therein, thereby providing another method of access to the bag interior 17. The front central horizontal opening 19 may be secured by a zipper fastener 9. The zipper fasteners 9, 18 used in this embodiment of the invention could be replaced with hook and pile type fastener strips of material, such as the well-known VELCRO products. The bag front 11 also has a secondary horizontal opening 8 formed adjacent to and below the top zipper fastener 18. The purpose of the front secondary horizontal opening 8 is to provide access to the audio system controls 48 discussed in detail below.

The bag 10 also has two interconnecting belts 20 attached thereto. In this embodiment of the invention the belt 20 is comprised of a left portion 21 and a right portion 26. The left portion 21 has a free end 22 terminating in a male-type bayonet buckle 23 and an opposite end 24 fixedly attached at a junction 25 formed by the left bag side 13 and the bag rear 12. The right portion 26 has a free end 27 terminating in a female-type bayonet receptacle buckle 28 and an opposite end 29 fixedly attached at a junction 30 formed by the right bag side 13 and the bag rear 12. The buckles 23, 28 used in this embodiment of the invention could also be replaced with hook and pile type fastener strips of material.

The audio system 40 includes a generally flat, rectangular housing 41 with a front 46, two sides 42, rear 43, top 44 and bottom 45. The housing 41 encloses a conventional audio tape player apparatus. It is important to note that, in keeping with the principles of the present invention, the audio system player could also be comprised of a CD player or radio. The controls 48 for the audio system protrude through the housing front 46. Access for recording media, i.e., tapes, CDs, is made through a simple door 47 on top 44 of the housing 41. In this embodiment of the invention the housing 41 has two front speakers 49 fixedly attached to the housing front 46 near to the housing sides 42 and connected to the audio player apparatus within the housing 41. The housing also has two rear speakers 50 attached by speaker wires 51 to the housing rear 43 and connected to the audio player apparatus within the housing 41.

The audio system 40 is fitted into the bag 10 through the opened bag top 44. The housing top 44 has four fasteners 52 fixedly attached thereto. Each fastener 52 is located near to a corner 53. The bag 10 has a side flap 31 within the bag interior 17 attached to each bag side 13 just below the zipper fastener 18. Each side flap 31 has two fasteners 32 fixedly attached thereto. The housing front 46 also contains two fasteners 54 each near to a front speaker 49. The bag front 11 has two fasteners 33 fixedly attached thereto in the bag interior 17, one fastener 33 on each side of the secondary opening 8. The flap fasteners 32 mate with the housing top fasteners 52 and the bag front fasteners 33 mate with the housing front fasteners 54 thereby holding the housing 41 in place within the bag interior 17 near to the bag top 14. The bag interior 17 has a large protective pocket 34 open at the top formed near to and parallel with the bag rear 12. The protective pocket 34 also shields two smaller holding pockets 35 formed with the bag rear 12. Each audio system rear speaker 50 is positioned within a holding pocket 35. The position of the audio system 40 near the bag top 14 provides a fairly substantial storage area in the bag interior 17 between the audio system 40 and bag bottom 15. Access to the storage area portion of the bag interior 17 is made directly through the front horizontal opening 19. The zipper fastener 9 provides a means for closing the bag storage area.

As may be most clearly seen in FIG. 1, the invention 1 may be worn about the abdomen 2 of an expectant mother 3, wherein the bag 10 is held against the abdomen 2 by means of the bag belts 20. The audio system rear speakers 50 are thereby positioned adjacent to the fetus 4. The audio system 40 may be used to impart sound stimulus to the fetus 4 or to monitor sounds from the fetus 4. The expectant mother 3 may also store sundries within the bag interior 17 below the audio system 40. The bag may also be used independent of the expectant mother 3 and may be used as a simple audio system within a storage bag for providing sound stimulus to anyone carrying the bag or to anyone near to the bag. For example, a toddler in or near a stroller is provided sound stimulus. The bag's storage area within the bag interior 17 provides a handy compartment for wipes, diapers, and the like.

It is understood that the above-described embodiment is merely illustrative of the application. Other embodiments may be readily devised by those skilled in the art which will embody the principles of the invention and fall within the spirit and scope thereof.

I claim:

1. A fetal and infant audio bag apparatus, comprising:

a bag having a front, a rear, two sides, a top, a bottom, an outer surface, and an interior, said top being directly attached to the rear and connected by means of a fastener to the two sides and front, said fastener providing access to the bag interior;

an audio system comprised of:

a generally flat, rectangular housing enclosing an audio player apparatus, said housing having a front, two sides, rear, top and bottom, said player apparatus having controls protruding from the housing front, said housing having a door on the housing top for access to recording media within the player apparatus, a plurality of front audio speakers fixedly attached to the housing front near to the housing sides and connected through the housing to said player apparatus, a plurality of rear speakers attached by speaker wires to the housing rear and connected through the housing to said player apparatus;

two interconnecting belts attached to said bag, said belts being comprised of a left portion and a right portion, said left portion having a free end terminating in a fastening means and an opposite end fixedly attached at a junction formed by a left bag side and the bag rear, said right portion having a free end terminating in a fastening means and an opposite end fixedly attached at a junction formed by a right bag side and the bag rear;

a plurality of fasteners fixedly attached the housing top, each fastener being located near to a housing corner;

a plurality of fasteners fixedly attached to said housing front each fastener being located near to a front speaker;

a side flap within the bag interior attached to each bag side below the fastener, means of the bag each side flap having a plurality of fasteners fixedly attached thereto;

a plurality of fasteners within the bag interior fixedly attached to bag front;

wherein said housing is fitted into the bag through the opened bag top, and said flap fasteners mated with said housing top fasteners and said bag front fasteners mated with the housing front fasteners thereby holding the housing in place within the bag interior near to the bag top.

2. A bag apparatus as recited in claim 1, further comprising:

a large protective pocket formed within the bag interior said large protective pocket having an open top, said pocket being formed near to and parallel with the bag rear;

a plurality of small holding pockets formed with the bag rear;

wherein each rear speaker is positioned within a respective holding pocket;

wherein a storage area is formed in the bag interior between the housing and bag bottom, and between the protective pocket and the bag front.

3. A bag apparatus as recited in claim 2, further comprising:

a central horizontal opening formed in the bag front, providing access to the bag interior;

a secondary horizontal opening formed in the bag front adjacent to and below the top fastener, said secondary opening providing access to the said controls.

4. A bag apparatus as recited in claim 3, further comprising:

a fastener securing said front central horizontal opening.

* * * * *